US005084326A

United States Patent [19]

Vöhringer

[11] Patent Number: 5,084,326

[45] Date of Patent: Jan. 28, 1992

[54] FORMING FABRIC FOR THE WET END OF A PAPERMAKING MACHINE

[75] Inventor: Fritz Vöhringer, Heidenheim, Fed. Rep. of Germany

[73] Assignee: F. Oberdorfer GmbH & Co. KG Industriegewebe-Technik, Heidenheim, Fed. Rep. of Germany

[21] Appl. No.: 484,491

[22] Filed: Feb. 23, 1990

[30] Foreign Application Priority Data

Mar. 22, 1989 [DE] Fed. Rep. of Germany ..... 3909534

[51] Int. Cl.[5] ..... B32B 23/02

[52] U.S. Cl. ..... 428/194; 51/298; 428/192; 428/193; 428/196; 428/240; 428/251; 428/225

[58] Field of Search ..... 428/192, 193, 194, 195, 428/240, 224, 251, 196, 225; 51/298

[56] References Cited

U.S. PATENT DOCUMENTS

| | | | |
|---|---|---|---|
| 2,718,791 | 9/1955 | Hosc et al. | 428/193 |
| 2,883,734 | 4/1959 | Draper | 428/193 |
| 2,922,442 | 1/1960 | Webber | 428/193 |
| 2,969,581 | 1/1961 | Bischoff | 428/193 |
| 3,515,623 | 6/1970 | Bates | 428/193 |
| 4,758,309 | 7/1988 | Johansson | 428/193 |
| 4,937,117 | 6/1990 | Yu | 428/192 |

*Primary Examiner*—James J. Bell

*Attorney, Agent, or Firm*—Gifford, Groh, Sprinkle, Patmore and Anderson

[57] ABSTRACT

A forming fabric for the wet end of a papermaking machine comprising a one-layered or multi-layered weave of metal or plastic and having in the region of its edgesided highly abrasive area an enforcement against abrasion by wearing. This enforcement is applied to the surface of the forming fabric and fixed thereto in form of an abrasive material so that the manufacture of the enforment can be carried out after weaving and fixed the fabric or after it has been cut and seamed.

14 Claims, 2 Drawing Sheets

FORMING FABRIC FOR THE WET END OF A PAPERMAKING MACHINE

BACKGROUND OF THE INVENTION

The invention relates to a forming fabric for the wet end of a papermaking machine, comprising a one-layered or multi-layered fabric of metal or plastic material provided at its edges or in the region thereof which is a highly abrasive area with a reinforcement against abrasion.

Such a kind of forming fabric is used for the manufacture of paper and is running as an endless belt through the rolling system of the wet end of the papermaking machine in order to dewater the fiber suspension so that a fiber web is formed and transported to the pressing part of the paper machine. During that operation a fabric may be moved with velocities up to 2,000 m/min. Because of the surface contact with the dewatering elements and the rolls of the rolling system these fabrics become worn, i.e. they are used up.

It was found out that the abrasion or the wear of these fabrics is independent from the kind of their construction and is occuring particularly quickly mainly in a stripe-like area adjacent to the edges of the fabric and parallel to them. This area of high abrasion which is called highly abrasive region (HVZ) is therefore a factor essentially contributing to the life time of such kind of fabrics. If the fabrics have reached a definite degree of abrasion it is likely that they crack in cross direction so that they cannot longer be used and must be replaced by new ones. The consequence of such a wear is therefore not the damage of the fabric per se but the stop of the machine and the loss of production output during the time in which such a fabric is replaced.

In order to increase the wear resistance of the highly abrasive regions it has already been proposed to weave into the fabric within these regions additional abrasive threads. This kind of enforcement, however, is disadvantageous therein that those threads must already been woven into the fabric during its manufacture. Because of the fact that the papermaking machine fabrics are of different widths these enforcement threads must be replaced for each fabric having an other width. For that purpose expensive readjustment operations are necessary. Moreover, the positioning of the enforcement threads during the weaving operation is also defining the width of the fabric. This means that weaving defects arising very often in the region of the weaving edge cannot be avoided by the styling of the fabric. Therefore, an enforcement of the highly abrasive regions by means of additional wearing threads has been proven to be rather ineconomical and is therefore performed only in special cases.

SUMMARY OF THE INVENTION

An object of the invention therefore resides in the manufacture of a forming fabric for the wet end of a paper making machine having not the above mentioned drawbacks.

According to that object of the invention the enforcement of the highly abrasive region should be reached in another way and with other means in order to avoid the above mentioned drawbacks.

Thus, the basic idea underlying the invention is to enforce the highly abrasive regions after the weaving and fixing of the fabric and not prior to these operations or, if requested, after cutting the fabric and its seaming.

For that purpose enforcing means in form of an abrasive material is applied onto or into, respectively, the highly abrasive regions of the forming fabric which are to be enforced.

In case the abrasive material should cover the highly abrasive regions only partly it can form according to an advantageous embodiment of the subject invention a line-like structure extending nearly parallel to the edges of the fabric or it can form a dot-like or stripe-like configuration applied to the surface of the fabric.

The abrasive material consists according to an especially advantageous further embodiment of the invention of a polymere mixed up with a melting adhesive. As such a polymere a polyester or a polyamide has been found to be essentially suited. The polymere may be present in form of monofiles or multifiles attached to the fabric by means of an adhesion promotor. Generally the abrasive material may be applied to the inner side as well as to the outer side of the fabric independently from its configuration appearing on the surface of the fabric, because the abrasion is occuring generally on both sides of the fabric in a more or less extensive manner.

The abrasive material is appropriately applied to the screen or fabric in such a way that it is at least partly entering into and anchoring in the weave body. The application of the abrasive material, which can happen in the above mentioned dot-like, stripe-like or line-like configurations is advantageously made in the form of spinning threads or thread particles.

The thickness of the abrasive material extending or spreading over the surface of the weave has been proved to be especially advantageous in the range of 10 $\mu$m to 300 $\mu$m. In this connection it goes without saying that finally the thickness depends from the type of abrasive material and the average life time of the fabric weave, taking into consideration corresponding values or experiences and the fact that it is intended to apply the abrasive material during that time when the screen or fabric per se must be replaced because of the normal wear of other regions of its surface than the regions of high abrasion.

Because of the fact that the abrasive material naturally reduces within the highly abrasive regions the permeability of those regions for the water which is to be removed from the pulp, it has been found to be appropriate to apply the abrasive material onto the surface of the fabric in the above mentioned several kinds of application or patterns in order to control the permeability. A defined diminishing of the permeability within the highly abrasive regions can in this connection even have the additional effect of diminishing the abrasion, because it is counteracting the effect that the edges of the fiber web being formed on the fabric are getting dry.

DESCRIPTION OF THE DRAWINGS

A better understanding of the invention will be reached by reference to the following detailed description when read in conjunction with the accompanying drawings, in which.

Figure 1:
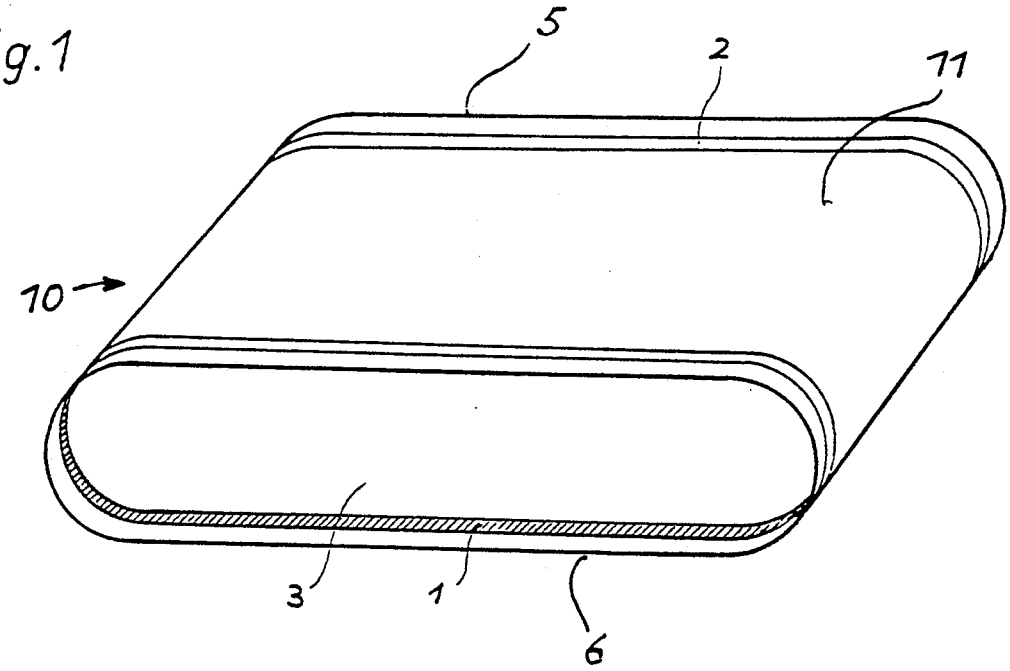
FIG. 1 is a perspective view of an endless forming fabric in a diminished scale, provided at its edges with highly abrasive regions being applied on the inner side and the outer side of the fabric with an abrasive material.
Figure 2:
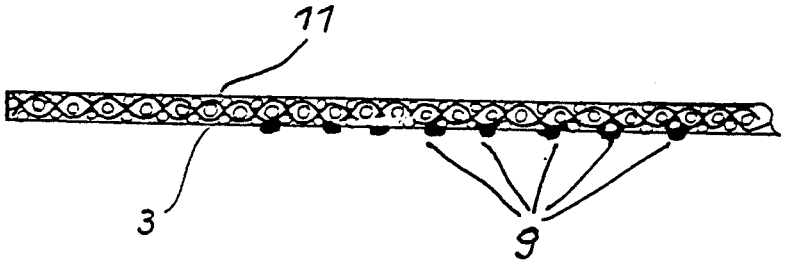
FIG. 2 is a cross sectional view of a fabric according to FIG. 1, on the inner side of which the abrasive material is applied in a dot-like manner.

The endless forming fabric 10 diametrically shown in FIG. 1 which can consist of a one-layered or multi-layered web of metal threads or plastic threads is provided in the range of its edgesided highly abrasive regions on the inner side 3 of the forming fabric as well as on its outer side 11 with an enforcement 1, 2 in form of an abrasive material consisting of a polymere mixed up with a melting adhesive and being for instance a polyester or a polyamide. The abrasive material forms a line-like structure 7 extending parallel to the edges 5, 7 of the forming fabric 10 as can be gathered from FIG. 3 and consisting of groups of lines extending in longitudinal direction of the forming fabric the distances of the single lines thereof may be chosen such that the required permeability of the enforcement 1, 2 for the water which is to be removed from the pulp may be precisely gained.

In this connection it was found out that a definite decrease of the permeability is even additionally reducing the abrasive effect in such a way that the abrasion is diminished because the decreased permeability opposes drying of the edges of the fiber web being formed on the fabric.

Thus, the manufacture of the enforcement of the highly abrasive regions, i.e. the application of the abrasive material, is carried out only after the manufacture of the forming fabric, wherein, as shown in FIG. 1 the enforcement of the highly abrasive regions is appropriately accomplished only after cutting and seaming of the fabric, although this is not a condition, i.e. not absolute necessary. Thus the enforcement forms a band-like configuration extending continuously on both sides of the edges 5, 6 of the forming fabric in longitudinal direction of that fabric.

Figure 5:
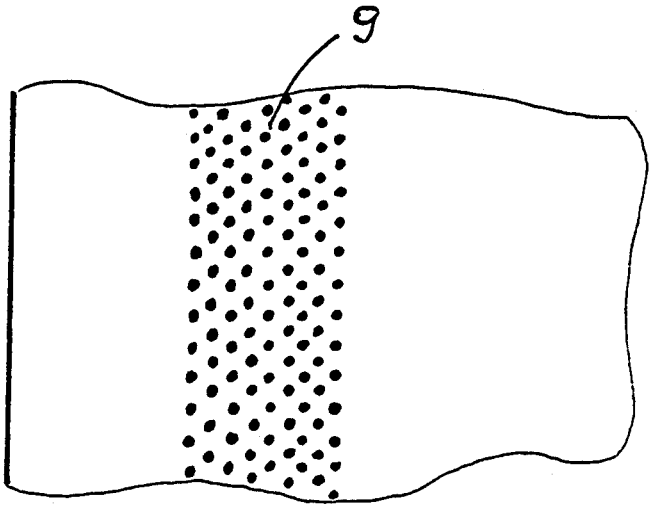
FIG. 5 is a plan view similar to the FIGS. 3 and 4, in which the abrasive material is applied in a dot-like manner to the surface of the fabric in accordance with the sectional view of FIG. 2.

As shown in an increased scale by the partial longitudinal sectional view of the forming fabric in FIG. 1 the abriasive mass or material can also be applied to the surface of the fabric in a dot-like form 9, so that in general the configuration of the fabric surface occurs as shown in a plan view in FIG. 5 This dot-like configuration is formed by droplets which can include solid particles of a material of high wear resistance. Such particles can for instance be cuts of polyamide-monofilaments or -multifilaments.

Figure 3:
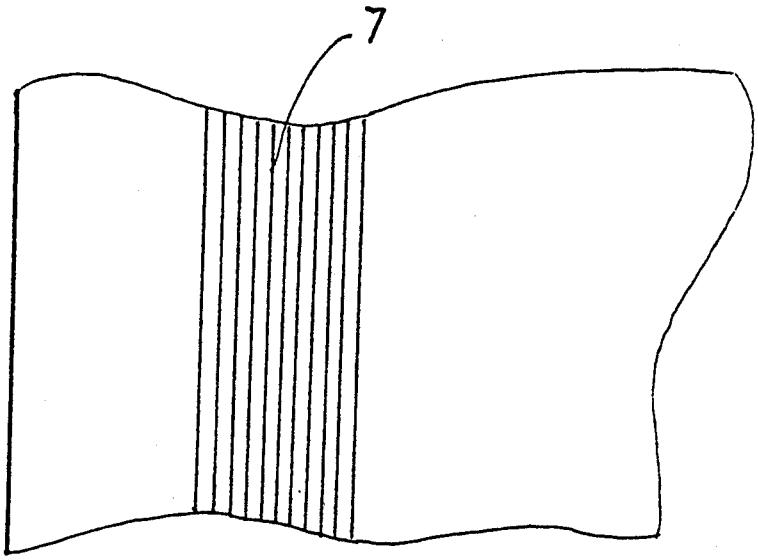
FIG. 3 is a diametrical plan view of a part of the edge of the forming fabric onto which the abrasive material is applied in form of generally parallel extending lines.
Figure 4:
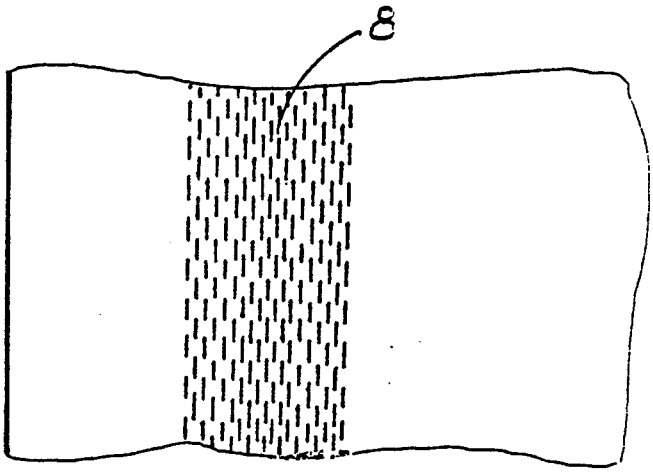
FIG. 4 is a diametrical plan view similar to FIG. 3 of a part of the edge region of the forming fabric onto which the abrasive material is applied in form of stripes consisting of single succeeding and adjacent dashes.

The abrasive material consists in the configurations as shown in the Figures of the drawings, i.e. in the line-like structure 7 of FIG. 3, the stripe-like structure 8 of FIG. 4 and the dot-like structure 9 in FIG. 5, of a polymere which is mixed with a melting adhesive and is appropriately a polyester or a polyamide. In those cases, in which the polymere consists at least partly of monofiles or multifiles, these threads may be applied to the fabric after having been sprinkled or impregnated with an adhesive promotor so that they may be attached to the fabric. These threads can be gained from a polyester melt or polyamide melt, for instance by means of a spinning jet in form of spinning threads and then be applied to the surface of the fabric in a coating-like manner. In order to improve the adhesion on the forming fabric the melt may also contain in such a case an adhesive material, for instance a melting adhesive.

Instead of in a configuration of entire threads the abrasive material may also be applied on the forming fabric in form of thread particles which, as already pointed out in connection with FIG. 5 may thereafter be put down in a troplet-like manner enclosed by a melting adhesive.

Independent from the chosen structuring of the abrasive material or mass on the surface of the forming fabric which structuring is for instance shown in FIGS. 3 through 5 being not of any limited character, because also many other structures fulfill the same object of providing a lateral wear region on the already manufactured forming fabric, the amount of the abrasive mass which is to be applied is chosen in accordance with the specific conditions. A condition for that amount is not only the required permeability of the abrasive region for water, but also the required life time which need naturally not to be longer than the average life time of the remaining parts of the forming fabric. From this condition does not only depend the material used as abrasive mass which can be as above mentioned stated polyamide and polyester besides of the fact that also other wear resistant materials known to a person skilled in the art may be used. The average thickness of the material applied to the surface of the fabric has also to be made dependent from that condition and in this connection values of thickness between about 30 μm to about 150 μm have been proved to be essentially favorable.

While the present invention has been particularly shown and described with reference to preferred embodiments thereof, it will be understood by those skilled in the art that the foregoing and other changes in form and details can be made therein without departing from the spirit and scope of the invention.

I claim:

1. A forming fabric for the wet end of a papermaking machine manufactured of at least a one-layered weave of plastic said forming fabric having highly abrasive areas along opposing edges thereof, said forming fabric having an enforcement for protecting said highly abrasive areas against abrasion by wearing, said enforcement is applied to said weave in the form of an abrasive material securely connected to said weave, said abrasive material only partly covers the highly abrasive areas, said abrasive material comprising a polymere mixed with a melting adhesive to facilitate bonding of said polymere to said forming fabric.

2. The forming fabric according to claim 1 wherein the abrasive material forms a line-like structure extending parallel to the edges of said forming fabric.

3. The forming fabric according to claim 1 wherein the abrasive material is applied to said forming fabric in a dot-like manner.

4. The forming fabric according to claim 1 wherein the abrasive material is applied to said forming fabric in a stripe-like manner.

5. The forming fabric according to claim 1 wherein said polymere is selected from the group consisting of a polyester or polyamide.

6. The forming fabric according to claim 5 wherein said polymere consists at least partly of monofiles or multi-files fixed to the surface of said forming fabric by an adhesion promotor.

7. The forming fabric according to claim 1 wherein said abrasive material is applied to an inner side as well as to an outer side of said forming fabric.

8. The forming fabric according to claim 1 wherein said weave of said forming fabric is at least partly impregnated by said abrasive material so that that said abrasive material is anchored within said weave.

9. The forming fabric according to claim 1 wherein said abrasive material is applied to said forming fabric in the form of spinning threads.

10. The forming fabric according to claim 1 wherein said abrasive material is applied to said forming fabric in the form of thread particles.

11. The forming fabric according to claim 1 wherein said abrasive material is applied to said forming fabric such that it extends over its surface by an average thickness of 30 μm to 150 μm.

12. The forming fabric according to claim 1, said forming fabric manufactured of at least a multi-layered weave of plastic.

13. The forming fabric according to claim 1, said forming fabric manufactured of at least a multi-layered weave of metal.

14. The forming fabric according to claim 1, said forming fabric manufactured of at least a one-layered weave of metal.

* * * * *